United States Patent [19]

Greenwood

[11] Patent Number: 5,031,529

[45] Date of Patent: Jul. 16, 1991

[54] INKING SYSTEM FOR LITHOGRAPHIC PRINTING

[75] Inventor: Richard P. Greenwood, Skipton, England

[73] Assignee: Vickers PLC, London, England

[21] Appl. No.: 512,046

[22] Filed: Apr. 19, 1990

Related U.S. Application Data

[63] Continuation of Ser. No. 175,083, Mar. 30, 1988, abandoned.

[30] Foreign Application Priority Data

Apr. 8, 1987 [GB] United Kingdom ..... 8708401

[51] Int. Cl.[5] ..... B41F 31/08; B41F 7/20

[52] U.S. Cl. ..... 101/142; 101/451; 101/366

[58] Field of Search ..... 101/366, 169, 167, 157, 101/155, 154, 350, 451

[56] References Cited

U.S. PATENT DOCUMENTS

| | | | |
|---|---|---|---|
| 2,018,193 | 10/1935 | Smith | 101/366 |
| 3,587,463 | 6/1971 | Granger | 101/366 X |
| 4,009,657 | 3/1977 | Bonanno et al. | 101/366 X |
| 4,066,014 | 1/1978 | Van Haaften | 101/157 |
| 4,590,855 | 5/1986 | Schommer et al. | 101/157 |
| 4,625,643 | 12/1986 | Davis | 101/366 X |

FOREIGN PATENT DOCUMENTS

| | | | |
|---|---|---|---|
| 199520 | 10/1986 | European Pat. Off. | 101/154 |
| 691047 | 5/1953 | United Kingdom | 101/366 |

*Primary Examiner*—Clifford D. Crowder
*Attorney, Agent, or Firm*—Bromberg & Sunstein

[57] ABSTRACT

Ink is applied to a lithographic printing plate from an engraved roller provided with a plurality of cells in its surface. Ink is introduced into the cells by an inking device comprising a pressurized substantially closed ink duct defined by an axially extending sealing member contacting or close to the surface and an axially extending doctor blade in contact with the surface.

18 Claims, 3 Drawing Sheets

INKING SYSTEM FOR LITHOGRAPHIC PRINTING

Figure 1:
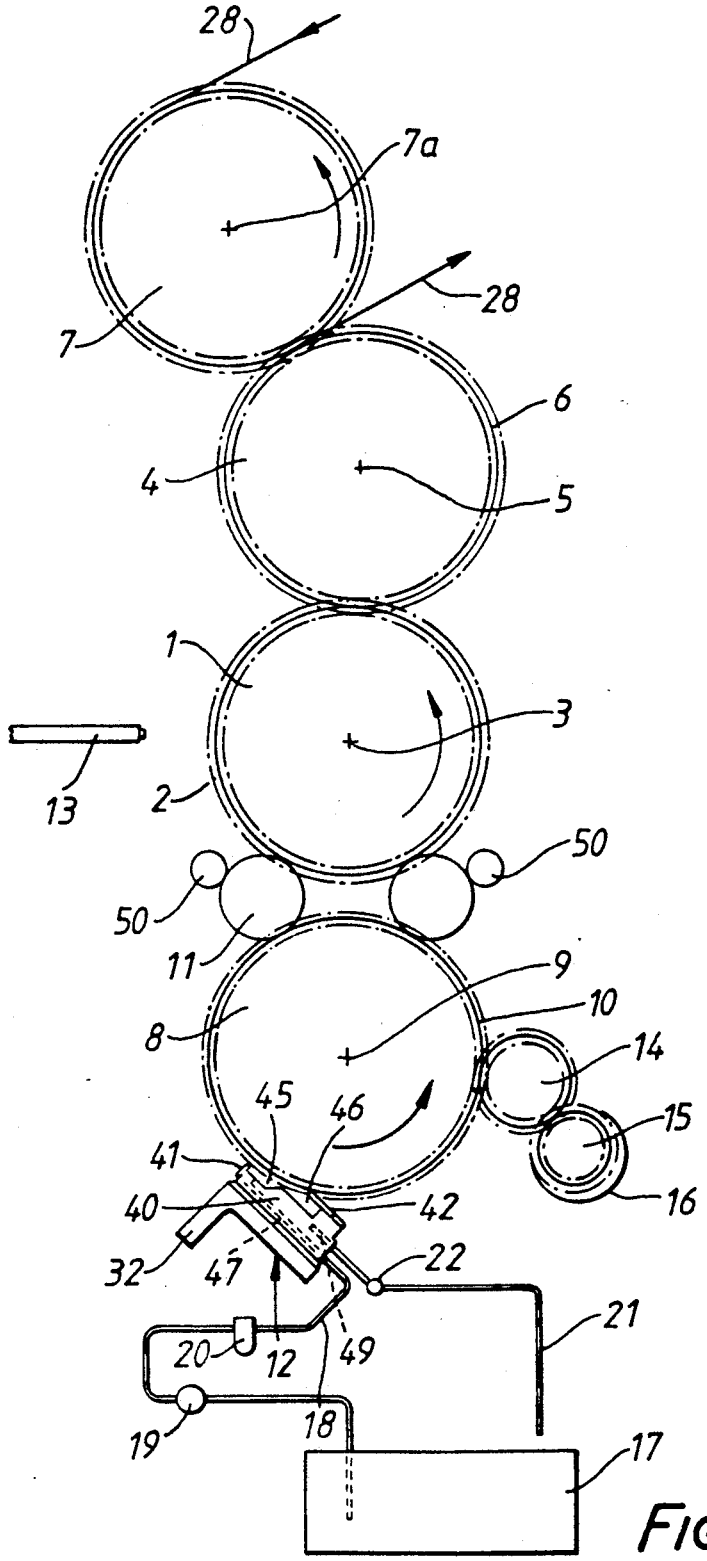

"This is a continuation of copending application(s) Ser. No. 07/175,083 filed on Mar. 30, 1988 now abandoned"

This invention relates to lithographic printing and is concerned with a lithographic printing press having a novel ink-applying mechanism.

Lithographic printing plates include a printing image area which is substantially co-planar with the non-printing area and the lithographic printing process relies on the differing affinities of these areas towards ink and water. The printing image is normally water repellent and ink receptive and the non-printing area is water receptive and ink repellent The lithographic printing plate is mounted on a plate cylinder and, during printing, an aqueous fountain solution is applied to the plate usually by means of a roller system or by a series of spray nozzles, the quantity of fountain solution applied being adjustable. The solution wets the non-printing area and is repelled by the printing image. Greasy lithographic printing ink is then applied to the plate. This is repelled by the wet non-printing area and received by the printing image The ink is then transferred from the printing image to the material to be printed, generally via the intermediary of an offset blanket.

Typically the ink is applied to the printing plate by an ink duct which includes a duct blade cooperating with the duct roller of the press unit. Ink is transferred from the duct roller to the printing plate via a series of rollers and the amount of ink received by the plate depends upon the amount of ink carried by the duct roller. The amount of ink carried by the duct roller is determined by a gap between the blade and the duct roller and this gap is controlled by a plurality of keys located at intervals along the blade. These keys need to be adjusted in order to obtain the correct ink level on the plate and such adjustment is time consuming and requires considerable skill. Alternatively, the adjustment of the duct blade can be carried out by electro-mechanical means to enable remote control to be achieved. The reliability and cost of such complex systems is however a disadvantage. Until such time as the correct ink/water balance is achieved, the printed copies produced are unsatisfactory and thus there is much wastage.

It is an object of the present invention to provide a means of applying ink to a lithographic printing plate which does not suffer from such disadvantages.

According to the present invention there is provided a lithographic printing press comprising:

(i) a plate cylinder mounted for rotation about its cylindrical axis and adapted to receive a lithographic printing plate, (ii) a means of applying an aqueous fountain solution to the lithographic printing plate, (iii) an inking device for applying ink to an engraved roller mounted for rotation about its cylindrical axis and having a cylindrical surface provided with a plurality of cells, said device comprising:

(a) a substantially closed axially extending ink duct for containing ink under pressure, said ink duct being bounded by said surface, an axially extending doctor blade in contact with said surface, and an axially extending sealing member, (b) a means of supplying ink from an ink source to said duct and thence into contact with said surface and into said cells, and (c) a means of returning ink from said duct to said source, (iv) a means of transferring ink from said cells to the lithographic printing plate, and (v) a means of transferring ink from said lithographic printing plate to material to be printed.

The axially extending sealing member will generally be spaced from the roller surface by as small a distance as possible so that the ink duct is, to all intents and purposes, substantially closed. Typically the gap between the sealing member and the roller surface will be less than 0.5 mm and preferably less than 0.2mm. However, in some circumstances it may be desirable for the axially extending sealing member to be in contact with the roller surface.

The cells on the roller surface may be provided by, for example, mechanical or electronic engraving in the case where the roller is steel or laser engraving in the case where the roller has a ceramic surface. The cells may be defined by from 150 to 500 lines per inch and the cells may be from 0.0002 to 0.010 thousandths of an inch deep.

During printing the ink duct becomes pressurised to a pressure of from 1 to 10 psi and the ink becomes deaerated and its rheology is adjusted. The ink is forced into the cells of the roller surface and it is believed that the ink completely fills the cells and thus prevents any possibility of excess fountain solution entering the cells and subsequently being transferred to the printing image. Moreover, the correct ink/water balance can be set up very quickly as a constant film of ink is applied to the printing image thus reducing the need for skilled operatives.

The inking device may be a single device extending along the entire axial length of the roller surface and sealed at the ends of said surface so that it has a width corresponding to the maximum width of the material to be printed. Alternatively, the press may include a plurality of narrower inking device closely arranged together side by side along the axial length of the roller surface with each device being individually sealed at its ends against the roller surface. This enables the printing of a material narrower than the normal maximum width simply by taking the superfluous device(s) out of service or by removing the superfluous device(s). In this way, the number of inking devices to be used in a given case can be selected in dependence upon the width of the material being printed. Moreover, a particularly useful advantage of this embodiment is that the inking devices may be mounted on the printing press in such a way that they can be readily detached and be replaced by another inking device (together with its ink reservoir containing ink of a different colour and its associated ink feed and discharge pipes) so that different colour printing across the full width of the material is readily facilitated. Moreover, it is particularly preferred for these detachable inking devices to be interchangeable, one with the other, along the axial length of the roller surface to facilitate printing in different colours. Alternatively this can be achieved by feeding different coloured inks to the inking devices without detaching and replacing the devices.

Figure 2:
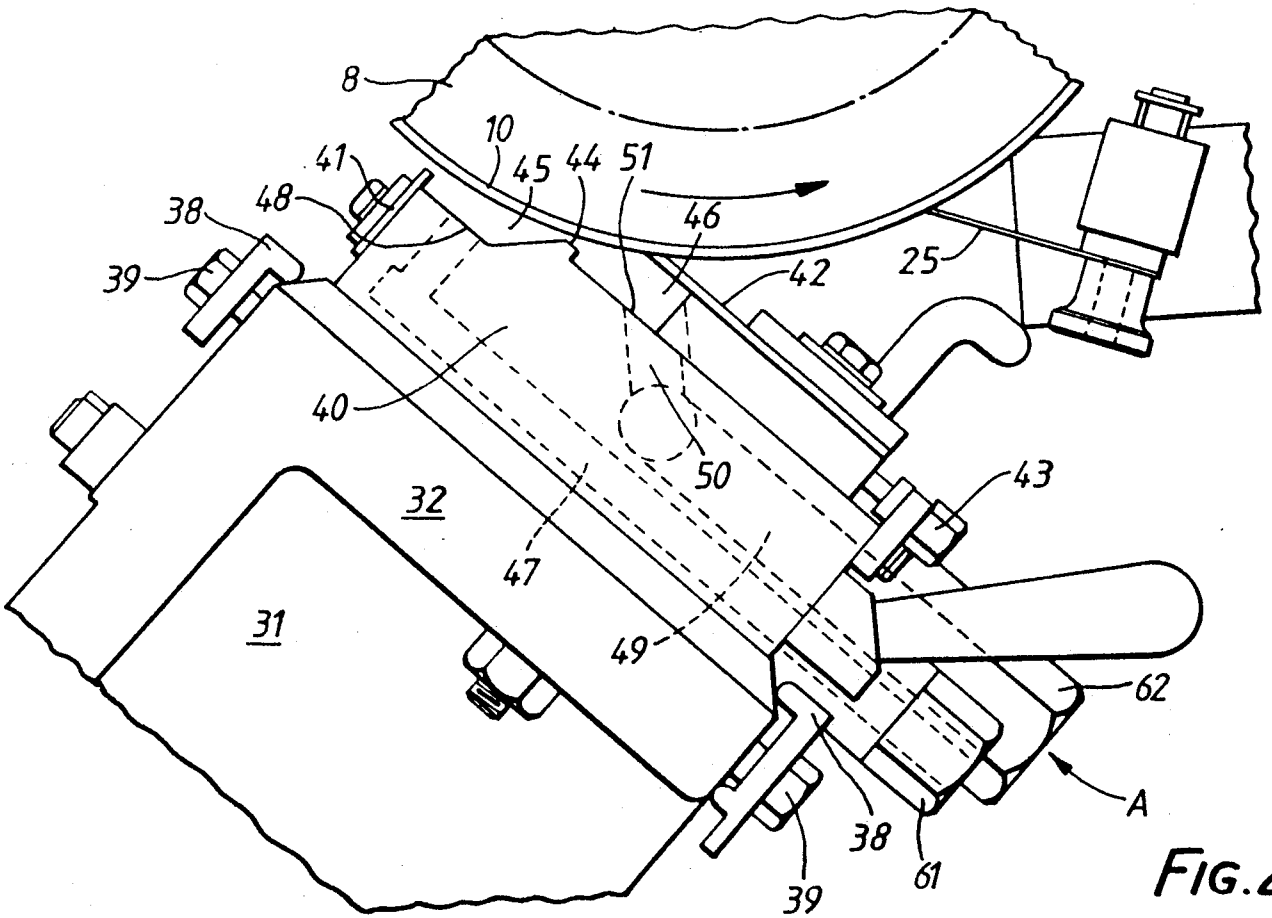
Figure 3:
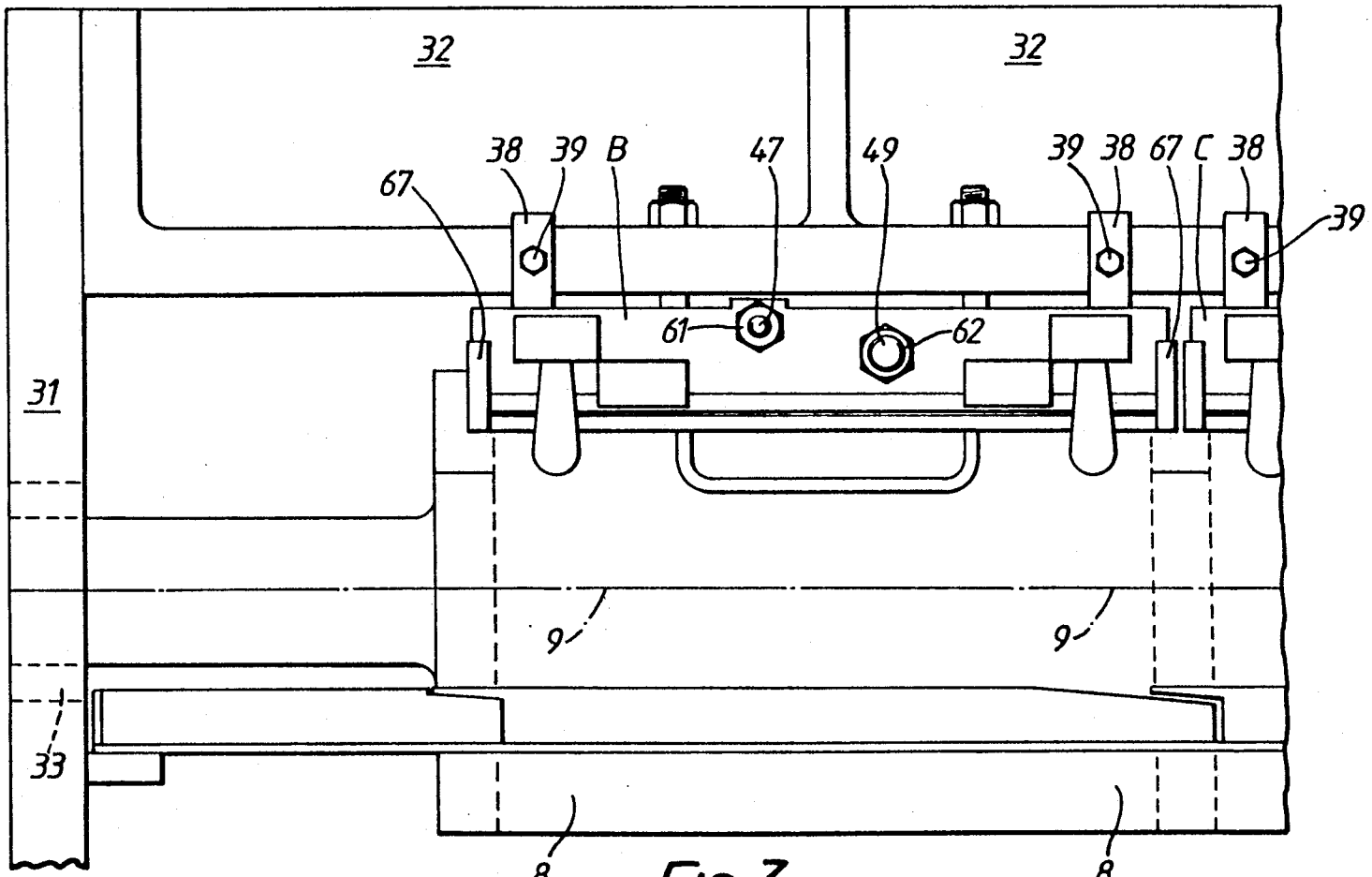

The fountain solution may be applied directly to the printing plate or to some other part of the press for subsequent transfer to the printing plate. Rollers of various types or sprays may be used to apply the fountain solution. For a better understanding of the invention and to show how the same may be carried into effect, reference will now be made, by way of example, to the accompanying drawings in which:

FIG. 1 is a diagrammatic side view of a lithographic printing press in accordance with the present invention, FIG. 2 is a side view of a part of the lithographic printing press shown in FIG. 1, and FIG. 3 is a view of the part of FIG. 2 in the direction A showing a part of the press width. Referring first to FIG. 1, the lithographic printing press comprises a plate cylinder 1 adapted to carry a lithographic printing plate 2 on its circumferential surface and mounted for rotation about its cylindrical axis 3. The press includes a blanket cylinder 4 mounted for rotation about its cylindrical axis 5 and carrying, on its circumferential surface, a resilient blanket 6. An impression cylinder 7 mounted for rotation about its cylindrical axis *7a* is provided to define a nip for the paper or the like with the blanket cylinder 4. The press also includes an engraved roller 8 for applying ink to the lithographic printing plate 2 on the plate cylinder 1. The roller 8 is mounted for rotation about its cylindrical axis 9 and it has a circumferential surface 10 which is provided with a plurality of cells. Located between roller 8 and plate cylinder 1 is a pair of resilient forme rollers 11 which run in contact with the surface 10 of the roller 8 and the surface of the printing plate 2 on the plate cylinder 1. (If desired, more than two forme rollers or a single forme roller may be provided). An inking device generally denoted by reference numeral 12 is provided to apply ink to the surface of the roller 8 and a spray device generally denoted by reference numeral 13 is provided to apply aqueous fountain solution directly to the surface of the printing plate 2 on the plate cylinder 1.

The roller 8 carries a gear ring which is in mesh with a gear 14 which in turn is in mesh with a gear 15 driven by main press motor 16. Plate cylinder 1, blanket cylinder 4 and impression cylinder 7 also carry gear rings so that they are geared together and the gear ring of the plate cylinder 1 is similarly driven by the main press drive motor 16 via gears (not shown).

The inking device 12 receives ink from a reservoir 17 via pipe 18 and pump 19 and filter 20 and ink is returned from the inking device 12 to the reservoir 17 via pipe 21 and a pressure relief valve 22. Alternatively, the valve 22 may be replaced or supplemented by a vent of predetermined size.

Referring now to FIGS. 2 and 3, these show a part of one side only of the press. The other side corresponds and hence has been omitted in the interests of clarity.

The printing press comprises a pair of side frames 31 (one side frame only being shown) with a rigid cast iron stretcher 32 pivotally mounted between the two. The roller 8 is mounted for rotation about its cylindrical axis 9 in journals 33 carried by the side frames. The press may include a plurality of such printing units(not shown) in which case they will all be driven by a suitable drive mechanism in conventional manner by the motor 16.

A plurality of inking devices (each of which may have a separate ink reservoir 17) is included in the printing press to apply ink to the printing image. Two of these are denoted by references B and C (FIG. 3). Each inking device is secured to the stretcher 32 by means of retaining plates 38 clamped to the stretcher 32 by bolts 39. Up to four such inking devices may be provided and they are mounted on the printing unit side by side along the axial length of the roller 8, or, alternatively, one full width inking device may be present.

Each inking device comprises a body portion 40 carrying an axially extending sealing member in the form of a plastics baffle 41 spaced from the cylindrical surface 10 of the roller 8 by less than 0.5mm and mounted normally with respect to the surface 10. The body portion 40 also carries an axially extending doctor blade 42 which contacts the cylindrical surface 10 of the roller 8. This blade 42 is flexible and formed, for example, of steel and is displaceably mounted on the body portion 40 so that it can be moved towards or away from the cylindrical surface 10 of the roller 8 by suitable rotating threaded adjusting bolt 43. In the embodiment shown in the drawings, the doctor blade 42 is shown contacting the surface 10 in the reverse angle position. However, in another embodiment, the doctor blade 42 may contact the surface 10 in a trailing position. Seals 67' bearing against the roller 8 are provided at each end of the inking device. The baffle 41, blade 42, and body portion 40 fit together in a fluid tight manner to form a chamber which is closed, or substantially closed, by the surface 10 of the roller 8 when roller 8 rotates so as to define an essentially closed ink duct extending along the width of the inking device. The body portion 40 also includes a protruding edge 44 extending along the width of the duct, the edge 44 being slightly spaced from the cylindrical surface 10 of the roller 8. Ordinarily, the gap between the protruding edge 44 and the cylindrical surface 10 of the roller 8 will be less than 0.5 mm. The protruding edge 44 divides the ink duct into a first zone 45 and a second zone 46. The body portion 40 incorporates an ink feed conduit 47 which terminates in an inlet port 48 in the first zone 45 of the ink duct between the baffle 41 and the protruding edge 44. The inlet port 48 is normally positioned midway between the ends of the ink duct. The body portion 40 also incorporates an ink discharge conduit 49 communicating with branch conduits 50 which terminate in outlet ports 51 normally located at each end of the second zone 46 of the ink duct. This arrangement enables ink to egress from the second zone 46 of the ink duct.

The free end of the ink feed conduit 47 terminates in a connector 61 whereby the ink feed pipe 18 (see FIG. 1) may be detachably connected thereto so that ink can be fed to the duct from its respective reservoir 17 via the pump 19 and the filter 20 associated therewith. The free end of the ink discharge conduit 49 terminates in a connector 62' whereby the ink discharge pipe 21 (see FIG. 1) may be detachably connected thereto so that ink can be conducted back to its reservoir 17.

In use ink is pumped from the reservoir 17 under pressure through the filter 20 and into the first zone 45 of the ink duct via ink feed pipe 18, conduit 47 and port 48. The ink flows between the protruding edge 44 and the surface 10 of the roller 8 and into the second zone 46 of the ink duct and thence returns via ports 51, conduits 50 and 49, and ink discharge pipe 21 back to the reservoir 17. Thus there is a continuous flow of ink from the reservoir 17 to the duct and back to the reservoir 17. During printing, rotation of the roller 8 in the direction of the arrow (i.e. in the same direction as the ink flow) transfers ink at high velocity through the narrow linear constriction defined by the edge 44 and thus high rates of shear are applied to the ink and a higher pressure is generated in the second zone 46. The pressure level in this second zone 46 is controlled by relieving the pressure via the variable valve 22 which can be preset as desired. Alternatively, the valve 22 may be replaced or supplemented by a vent having a specific area appropriate to the system so that the pressure in the second zone 46 is at the desired value. Generally the pressure in the second zone 46 will be from 1 to 10 psi and a pressure of 4 psi is typical under normal conditions.

It is believed that the effect of the high shear rate applied to the ink at the constriction as it transfers from zone 45 to zone 46 ensures that ink with constant rheological properties and without entrained air or fountain solution completely fills the cells of the engraved roller 8. The ink from the engraved roller 8 is transferred via the forme rollers 11 to the lithographic printing plate 2 where the water repellent ink-receptive printing image takes the ink away from the forme rollers 11. Ink is not received by the non-printing areas which have previously been wetted with fountain solution by the spray means 13. Ink is transferred from the printing image to blanket 6 and thence to web 28 of paper or the like passing through the nip between the blanket cylinder 4 and the impression cylinder 7. Where ink is not taken away from the forme rollers 11 by the printing image of the plate 2, it returns to the cells of the engraved roller 8 and is replaced with ink from the pressurised duct as the engraved roller 8 rotates through the constriction and the higher pressure zone 46. The baffle 41 prevents contaminants entering the duct and also confines the ink within the duct during operation of the press. Ink is removed from the surface 10 by the doctor blade 42 and is returned to the reservoir 17 via the second zone 46 within which the ink is contained. Any unwanted ink escaping past the end of seals 67' of the inking devices is removed by an auxiliary scraper blade 25.

By appropriately setting the doctor blade 42, a consistent amount of deaerated ink (i.e. an amount determined by the volume of the cells) is transferred to the forme rollers 11 and thence to the printing plate 2. The cells in the surface 10 are completely filled with ink. Because of this, there is no possibility of aqueous fountain solution finding its way into the cells and thereby preventing the cells from being occupied by ink. The amount of ink carried by the roller 8 is consistent and thus little or no operator involvement is required at the inking device. The necessary balance between the amount of ink and water on the printing plate is determined by controlling the amount of aqueous fountain solution applied to the printing plate, and once this balance has initially been set up for constant operating conditions, no further adjustments need to be made during printing. By means of the present invention, the printing plate is provided with the optimum amount of ink which it needs irrespective of the speed of the press and thus much of the waste ordinarily produced at the start of a printing run can be eliminated.

In the embodiment shown, four inking devices are provided across the width of the printing press and the press is such that it can receive a web which has a width corresponding to four pages, each page being associated with one of the inking devices. In this way, four pages can be printed simultaneously. If, however, it is desired to use a narrower web and print less than four pages simultaneously, the appropriate number of inking devices can be taken out of service or be removed altogether after slackening bolts 39. In this way, only the number of inking devices appropriate to the width of the web being printed are used. If desired, each inking device may contain ink of a different colour so that, for example, four colours can be applied to a four page width web simultaneously. The inking devices are interchangeable so that they may readily be moved axially along the roller surface from one position to another as desired to facilitate printing in different colours. Printing in different colours can also be effected by disconnecting the ink feed and ink discharge pipes of a given inking device and connecting the ink feed and ink discharge pipes associated with a reservoir containing ink of a different colour.

In the embodiment shown, the aqueous fountain solution is applied directly to the lithographic printing plate 2 on the plate cylinder 1 by a spray mechanism. However, the fountain solution may be applied by rollers. Moreover, if desired, the solution may be applied either to one or both of the forme rollers 11 or to the roller 8. If desired, a rider roller 50, with or without reciprocation, may be provided on the or each forme roller 11.

I claim:

1. A lithographic printing press comprising:

(i) a plate cylinder mounted for rotation about its cylindrical axis and adapted to receive a lithographic printing plate, (ii) a means for applying an aqueous fountain solution to the lithographic printing plate, (iii) an inking device for applying ink to an engraved roller which is mounted for rotation about its cylindrical axis and has a cylindrical axis and has a cylindrical surface provided with a plurality of cells, said device comprising:

(a) a body portion, axially extending doctor blade carried by the body portion and in contact with said surface in the reverse angle position, and an axially extending sealing member carried by the body portion; said doctor blade, said sealing member, and said body portion fitting together in a fluid-tight manner to form an axially extending ink duct which is closed or substantially closed by said surface and which is for containing ink under pressure; said duct including a restriction defined by said surface and by a protruding edge spaced from said surface by less than 0.5 mm to divide the duct into first and second zones, (b) a means of supplying ink from an ink source to said first zone of the duct from where the ink is transferred at high velocity to the second zone via said constriction by rotation of the engraved roller to generate higher pressure in the second zone and to subject the ink to shear as it passes between the protruding edge and said surface to adjust its rheology so that ink of adjusted rheological properties completely fills said cells in said surface, and (c) a means of returning ink from said second zone of the duct to said source, and (iv) a means of transferring ink from said lithographic printing plate to material to be printed.

2. A press as claimed in claim 1 wherein the axially extending sealing member is spaced from the roller surface by less than 0.5 mm.

3. A press as claimed in claim 1 wherein a means is provided to control the pressure generated in said second zone due to rotation of the engraved roller.

4. A press as claimed in claim 3 wherein said means to control the pressure is a pressure relief valve.

5. A press as claimed in claim 1 and including a plurality of said inking devices arranged side by side along the axial length of the roller.

6. A press as claimed in claim 5 wherein each inking device has a separate ink source.

7. A method of lithographic printing comprising:

(i) providing a plate cylinder mounted for rotation about its cylindrical axis and adapted to receive a lithographic printing plate, (ii) applying an aqueous fountain solution to the lithographic printing plate, (iii) applying ink, with an inking device, to an engraved roller which is mounted for rotation about its cylindrical axis and has a cylindrical surface provided with a plurality of cells, and said device comprising:

(a) a body portion, an axially extending doctor blade carried by the body portion and in contact with said surface in the reverse angle position, and an axially extending sealing member carried by the body portion; said doctor blade, said sealing member, and said body portion fitting together in a fluid tight manner to form an axially extending ink duct which is closed or substantially closed by said surface and which is for containing ink under pressure; said duct including a constriction defined by a protruding edge spaced from said surface by less than 0.5 mm to divide the duct into first and second zones, (b) a means of supplying ink from an ink source to said first zone of the duct from where the ink is transferred at high velocity to the second zone via said constriction by rotation of the engraved roller to generate higher pressure in the second zone and impart constant rheological properties to the ink so that it completely fills said cells, and (c) a means of returning ink from said second zone of the duct to said source, (iv) transferring ink from said cells to the lithographic printing plate, and (v) transferring ink from said lithographic printing plate to material to be printed.

8. A method as claimed in claim 7 wherein the axially extending sealing member is spaced from the roller surface by less than 0.5 mm.

9. A method as claimed in claim 7 and comprising the step of controlling the pressure generated in said second zone due to rotation of the engraved roller.

10. A method as claimed in claim 9 wherein the pressure is controlled by releasing the pressure at a desired value.

11. A method as claimed in claim 7 and comprising the step of applying ink to the engraved roller with a plurality of said inking devices arranged side by side along the length of the roller.

12. A method as claimed in claim 11 and comprising the step of supplying ink to each inking device from a separate ink source.

13. A method of lithographic printing comprising:

(i) providing a plate cylinder mounted for rotation about is cylindrical axis and adapted to receive a lithographic printing plate, (ii) applying an aqueous fountain solution to the lithographic printing plate, (iii) providing adjacent to an engraved roller which is mounted for rotation about its cylindrical axis and has a cylindrical surface provided with a plurality of cells: (a) body portion, (b) an axially extending doctor blade carried by the body portion and in contact with said surface in the reverse angle position, and (c) an axially extending sealing member carried by the body portion, such that said doctor blade, said sealing member, and said body portion are fitted together in a fluid tight manner to form an axially extending ink duct which is closed or substantially closed by said surface and which is for containing ink under pressure, and such that said duct including a constriction defined by a protruding edge spaced from said surface by less than 0.5 mm to divide the duct into first and second zones, (iv) supplying ink from an ink source to said first zone of the duct from where the ink is transferred at high velocity to the second zone via said constriction by rotation of the engraved roller to generate higher pressure in the second zone and impart constant rheological properties to the ink so that it completely fills said cells, and (v) returning ink from said second zone of the duct to said source, (vi) transferring ink from said cells to the lithographic printing plate, and (vii) transferring ink from said lithographic printing plate to material to be printed.

14. A method as claimed in claim 13, further including the step of spacing the axially extending sealing member less than 0.5 mm from the roller surface.

15. A method claimed in claim 13, further including the step of controlling the pressure generated in said second zone due to rotation of the engraved roller.

16. A method as claimed in claim 15, further including the step of providing a pressure relief valve to control the pressure generated in said second zone.

17. A method as claimed in claim 13, further including the step of applying ink to the engraved roller with plurality of said ink ducts.

18. A press as claimed in claim 17 further including the step of providing each ink duct with a separate ink source.

* * * * *